US008814592B2

(12) United States Patent
Potet

(10) Patent No.: US 8,814,592 B2
(45) Date of Patent: Aug. 26, 2014

(54) HYPERFREQUENCY CONNECTION ASSEMBLY HAVING A BODY WITH AN INNER PASSAGE FOR ACCOMMODATING A CONDUCTIVE ROD SURROUNDED BY AN INSULATING RING

(71) Applicant: Radiall, Rosny Sous Bois (FR)

(72) Inventor: Nicolas Potet, Saint Quentin Fallavier (FR)

(73) Assignee: Radiall, Rosny Sous Bois (FR)

( * ) Notice: Subject to any disclaimer, the term of this patent is extended or adjusted under 35 U.S.C. 154(b) by 36 days.

(21) Appl. No.: 13/747,830

(22) Filed: Jan. 23, 2013

(65) Prior Publication Data

US 2013/0196536 A1 Aug. 1, 2013

(30) Foreign Application Priority Data

Jan. 26, 2012 (FR) ..... 12 50766

(51) Int. Cl.
*H01R 9/05* (2006.01)

(52) U.S. Cl.
USPC ..... 439/578

(58) Field of Classification Search
USPC ..... 439/578–585, 548–556
See application file for complete search history.

(56) References Cited

U.S. PATENT DOCUMENTS

| | | | | |
|---|---|---|---|---|
| 3,936,132 | A * | 2/1976 | Hutter | 439/551 |
| 6,280,208 | B1 * | 8/2001 | Masuda et al. | 439/98 |
| 6,508,666 | B1 * | 1/2003 | Francis | 439/548 |
| 8,016,615 | B2 * | 9/2011 | Montena | 439/580 |
| 8,317,538 | B2 * | 11/2012 | Carle et al. | 439/548 |
| 8,419,469 | B2 * | 4/2013 | Montena | 439/578 |
| 2004/0014358 | A1 | 1/2004 | Leve | |
| 2009/0137150 | A1 | 5/2009 | Huang et al. | |
| 2011/0161050 | A1 | 6/2011 | Montena et al. | |

OTHER PUBLICATIONS

French Search Report, dated Oct. 5, 2012, which issued during the prosecution of French Patent Application No. 1250766, to which this application claims priority.

* cited by examiner

*Primary Examiner* — Chandrika Prasad
(74) *Attorney, Agent, or Firm* — Troutman Sanders LLP

(57) ABSTRACT

The hyperfrequency connection element according to the invention, designed to be electrically connected with a complementary connector, comprises: a body having an inner passage surrounding a central axis, a monolithic conductive contact rod extending along the central axis, an insulating ring surrounding the central axis, The body includes at least one hole that connects an outer surface of the connector to the inner passage. The ring is solid and deformable and includes an outer peripheral slot communicating with the hole. A resin securing the ring with the body is housed in the hole and in the slot of the ring, and the ring is removable before the resin is housed in the hole and in the slot of the ring.

10 Claims, 5 Drawing Sheets

HYPERFREQUENCY CONNECTION ASSEMBLY HAVING A BODY WITH AN INNER PASSAGE FOR ACCOMMODATING A CONDUCTIVE ROD SURROUNDED BY AN INSULATING RING

CROSS-REFERENCE TO RELATED APPLICATIONS

The present application claims priority to French Application No. 1250766 filed Jan. 26, 2012. This application is incorporated herein by reference in its entirety.

FIELD OF INVENTION

The present invention relates to a hyperfrequency connection element, as well as a hyperfrequency connection assembly comprising at least one such element.

BACKGROUND

Within the meaning of the present invention, a component is said to be "hyperfrequency" when it is capable of operating in the hyperfrequency range, for example at frequencies above 1 GHz. An element is "conductive" when it allows electrical current to pass, unlike an "insulating" element.

A hyperfrequency connection element or connector, such as the coaxial connector disclosed by US Publication No. 2011/0161050, generally includes a central conductor, made up of a conductive rod that defines a longitudinal axis of the connector, and an outer conductor arranged around the conductive rod and formed by a conductive body. The rod and the body are radially separated by an insulator that supports the rod. The connector is designed to fit with a complementary connector also comprising a central conductive rod, an insulator that supports the rod, as well as an outer conductive body. The two connectors can be mechanically disassembled relative to one another and when they are fitted together, electrical contact is established between the rods of the two connectors on the one hand, and between the bodies of the two connectors on the other hand. The signal transmitted by the connector to the complementary connector in particular passes in the form of waves into the space extending between the conductive rod and the conductive body, including in the insulation. The insulating elements that maintain the rod relative to the body are designed not to overly disrupt the electrical signal transmitted by the connector.

According to the prior art, to keep the rod in position relative to the body of the connector, it is in particular known to overmold an insulating washer around part of the rod. A first axial end of the washer is placed abutting against an inner shoulder of the body. A ring for maintaining the position is arranged radially between the washer and the body. One end of the ring includes an outer flange that locks the second end of the washer in contact with the shoulder of the body. In this way, in a radial direction, the connecting rod is kept in position by means of the overmolded washer and the ring. In an axial direction, the assembly formed by the rod and the overmolded washer is maintained on either side by the shoulder and by the flange of the ring.

The overmolding of a washer is relatively complex to do and sometimes creates burrs that must be eliminated in an additional manufacturing step.

In a known manner, the smaller the dimensions of a connector, the more it can operate at high frequencies. Furthermore, the transmission quality of the signal is conditioned by the characteristic impedance of the connector, which depends on the geometry of the connector and the dielectric constant of the insulating ring.

The connector with overmolded washer described above has a relatively complex geometry, and consequently is not easy to produce with dimensions making it possible to correctly transmit a signal with a frequency above 40 GHz. Furthermore, the complexity of this design causes significant allowances on the small dimensions of the connector, which risks deteriorating the transmission of the signal.

The manufacture and assembly of such a connector is relatively complex, in light of the number of component parts thereof. The superposition of the overmolded washer with the ring creates discontinuities that tend to disrupt the transmitted signal. In general, the body of a connector is mounted on a fixed platen and it is necessary to adjust the axial position of the rod relative to the body, so as to be able to maintain a quasi-constant characteristic impedance in the hyperfrequency line and thereby achieve a satisfactory electrical connection between the connector and a complementary connector. In order to fix the axial position of the rod precisely relative to the platen, it is known to insert adjusting shims between the connector and the platen. To adjust the position correctly, it is then necessary to disassemble the connector from the platen to be able to add or remove shims, which is costly and delicate to do, in light of the required dimensional precision.

The invention more particularly aims to resolve these drawbacks by proposing a connector having improved hyperfrequency performance, allowing an easy assembly that can be industrialized, with a simple design and making it possible to adjust the axial position of the connection rod precisely and easily.

SUMMARY

To that end, the invention relates to a hyperfrequency connection element, designed to be electrically connected with a complementary connector, including a body having an inner passage surrounding a central axis, a monolithic conductive contact rod extending along the central axis, and an insulating ring surrounding the central axis.

The body includes at least one hole that connects an outer surface of the connector to the inner passage. The ring is solid and deformable and includes an outer peripheral slot communicating with the hole. A resin securing the ring with the body is housed in the hole and in the slot of the ring. The ring is removable before the resin is housed in the hole and in the slot of the ring.

Owing to the invention, the number of parts of the connector is reduced, which facilitates the manufacture and assembly thereof, and does not introduce disruptions on the signal. The geometry of the connector is simple and, consequently, the characteristic impedance of such a connecting element is precisely controlled, which enables a satisfactory transmission of signals with a frequency above 50 GHz. Such a connecting element may have reduced dimensions, which allow satisfactory operation for high frequencies, in the vicinity of 50 GHz.

According to advantageous but optional features of the invention, such a connecting element may incorporate one or more of the following features, considered in all technically allowable combinations:

The ring includes a slit extending in a direction having at least one axial component and passing all the way through the ring, and the ring is formed by two separable half-rings.

The ring is monolithic and elastically deformable, and the ring includes a slit extending in a direction having at least one axial component, the slit passing only through a portion of the ring, the ring comprising two portions separated by the slit and connected to each other.

A first portion of the contact rod around which the ring is mounted has at least one raised element, and the translation and rotation of the ring relative to the contact rod, in relation to the central axis, are locked by the raised element.

The raised elements include at least one annular outer flange having a flat portion locking the rotation of the ring relative to the contact rod.

The ring is made from polytetrafluoroethylene.

The invention also relates to a hyperfrequency connection assembly including a platen and at least one such hyperfrequency element fastened to the platen.

The invention also relates to a method for manufacturing such a hyperfrequency connection element, having at least a step in which the insulating ring is placed around the conducting rod, a step in which the assembly formed by the ring and the conducting rod is inserted into the longitudinal passage of the body, and a step in which an adhesive material is injected into the hole to fill the slot of the ring.

According to advantageous, but optional features of the invention, such a method may incorporate one or more of the following features, considered in all technically allowable combinations:

The two half-rings are arranged on either side of the conducting rod.

The two portions of the ring are separated to insert the ring around the conducting rod.

BRIEF DESCRIPTION OF THE DRAWINGS

The invention will be better understood, and other advantages thereof will appear more clearly, upon reading the following description of a hyperfrequency connection element as well as a connection assembly comprising such an element, provided solely as examples and done in reference to the appended drawings, in which.

DETAILED DESCRIPTION

Figure 1:
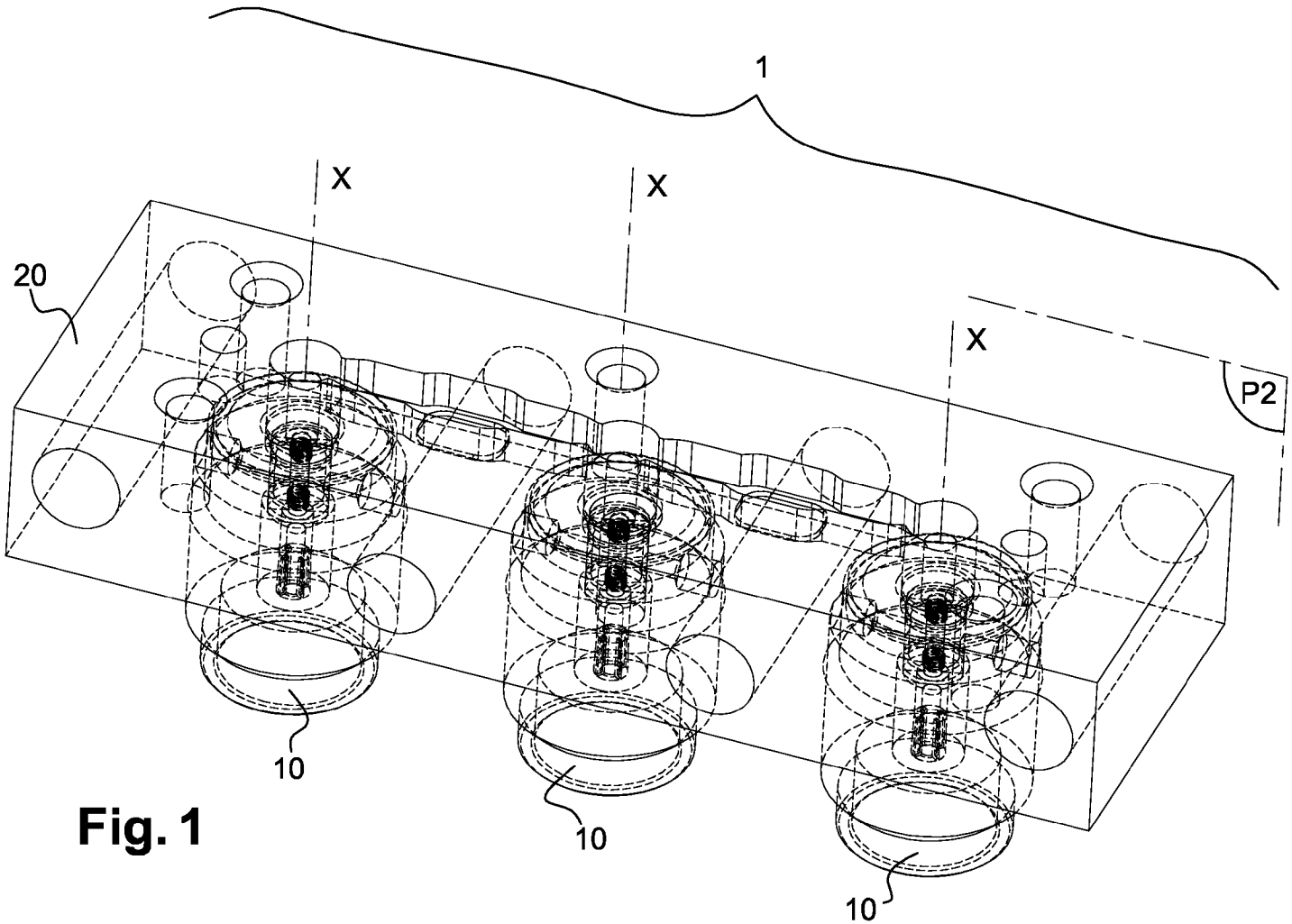
FIG. 1 is a perspective, partial cross-sectional view of a connection assembly according to the invention, comprising three identical connecting elements.
Figure 2:
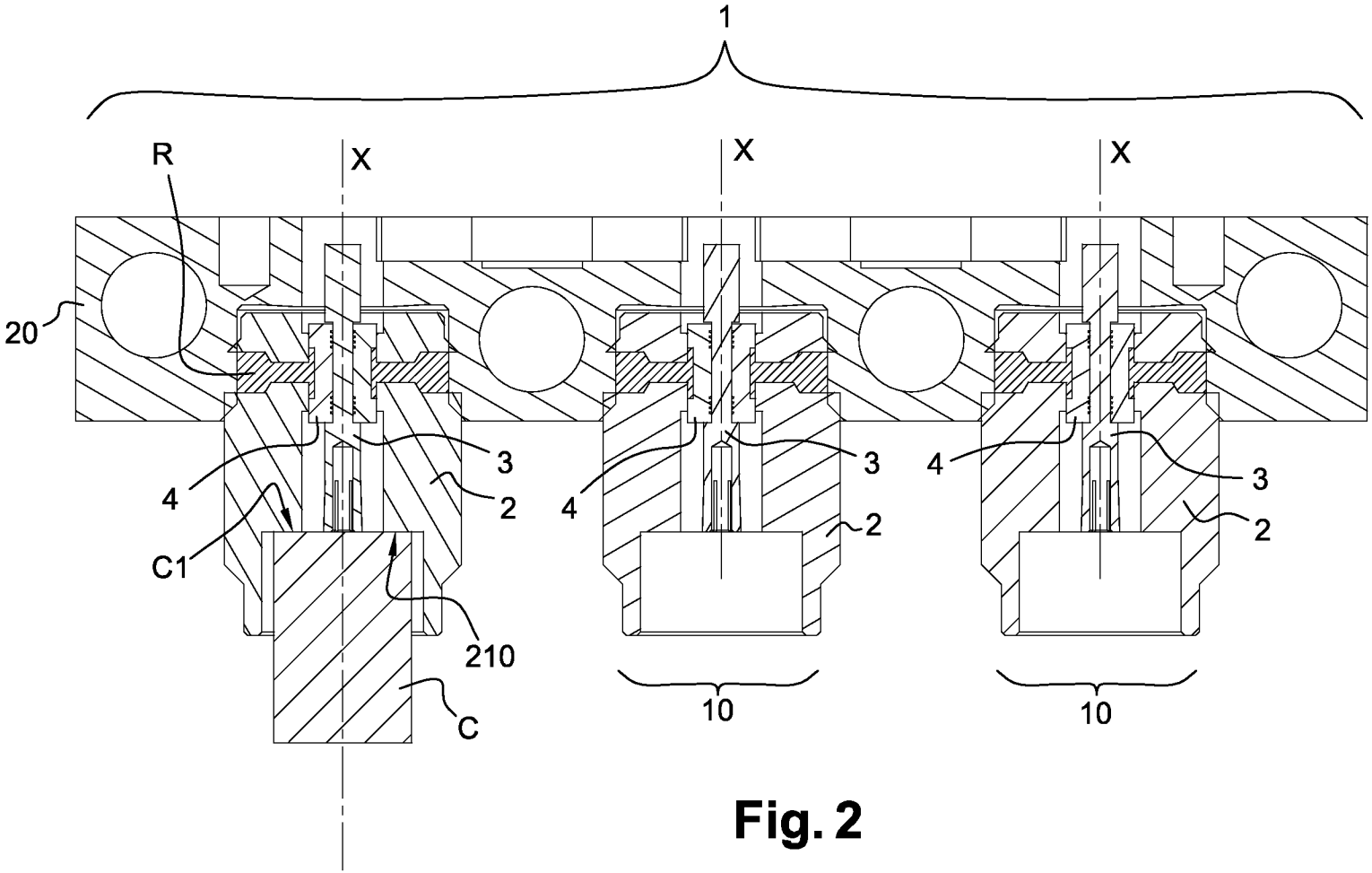
FIG. 2 is a cross-section along plane P2 in FIG. 1.

FIGS. 1 and 2 show a connection assembly 1 including three identical connection elements or connectors 10 mounted on a platen 20. A switching mechanism, not shown, is provided to put the conductive strips in contact with the connectors 10. The assembly 1 and the switching mechanism together form a switching assembly, commonly called a "relay." According to the invention, the assembly 1 is not limited to the arrangement of the connectors 10 shown in FIGS. 1 and 2.

Figure 3:
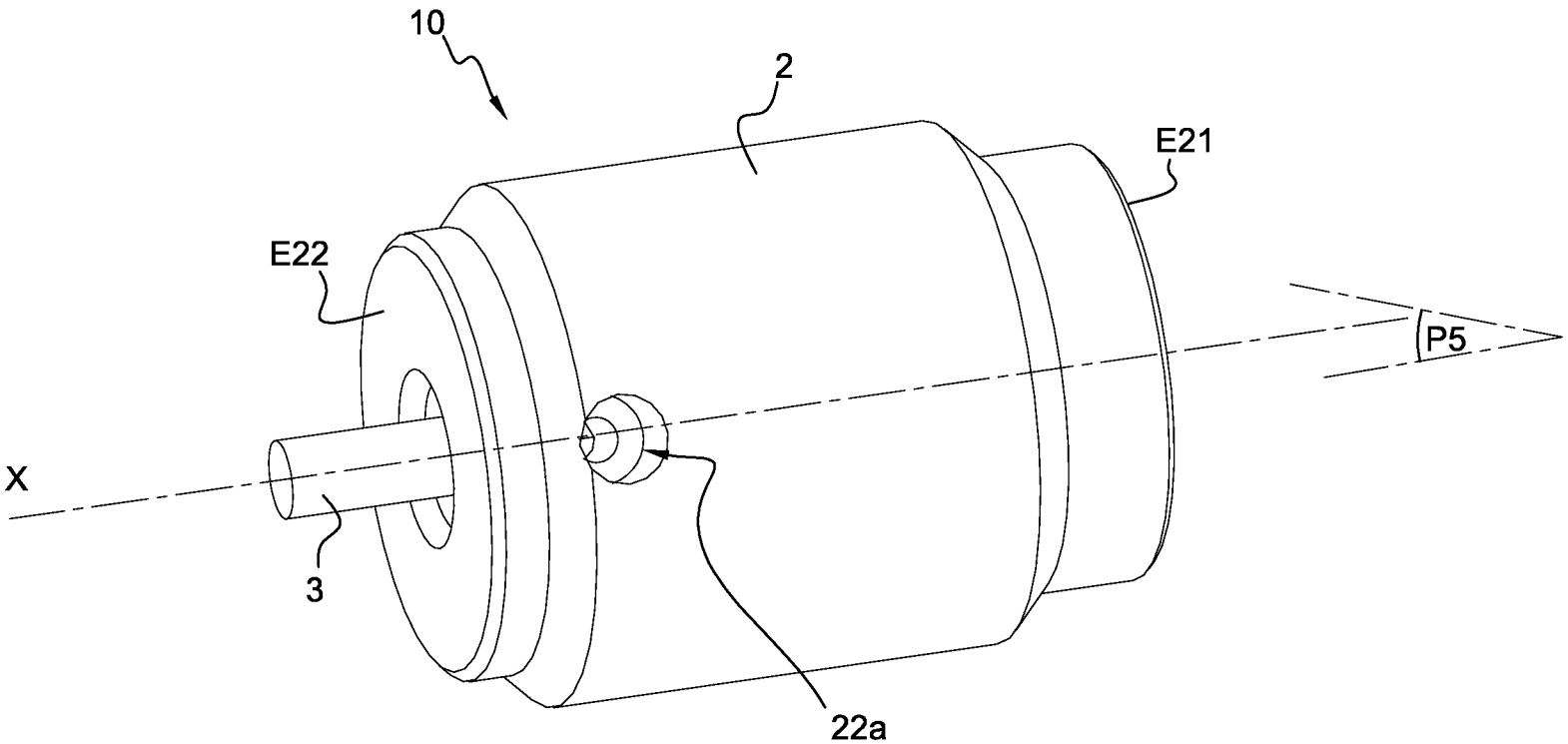
FIG. 3 is a perspective view of a connection element that is part of the connection assembly of FIG. 1.
Figure 4:
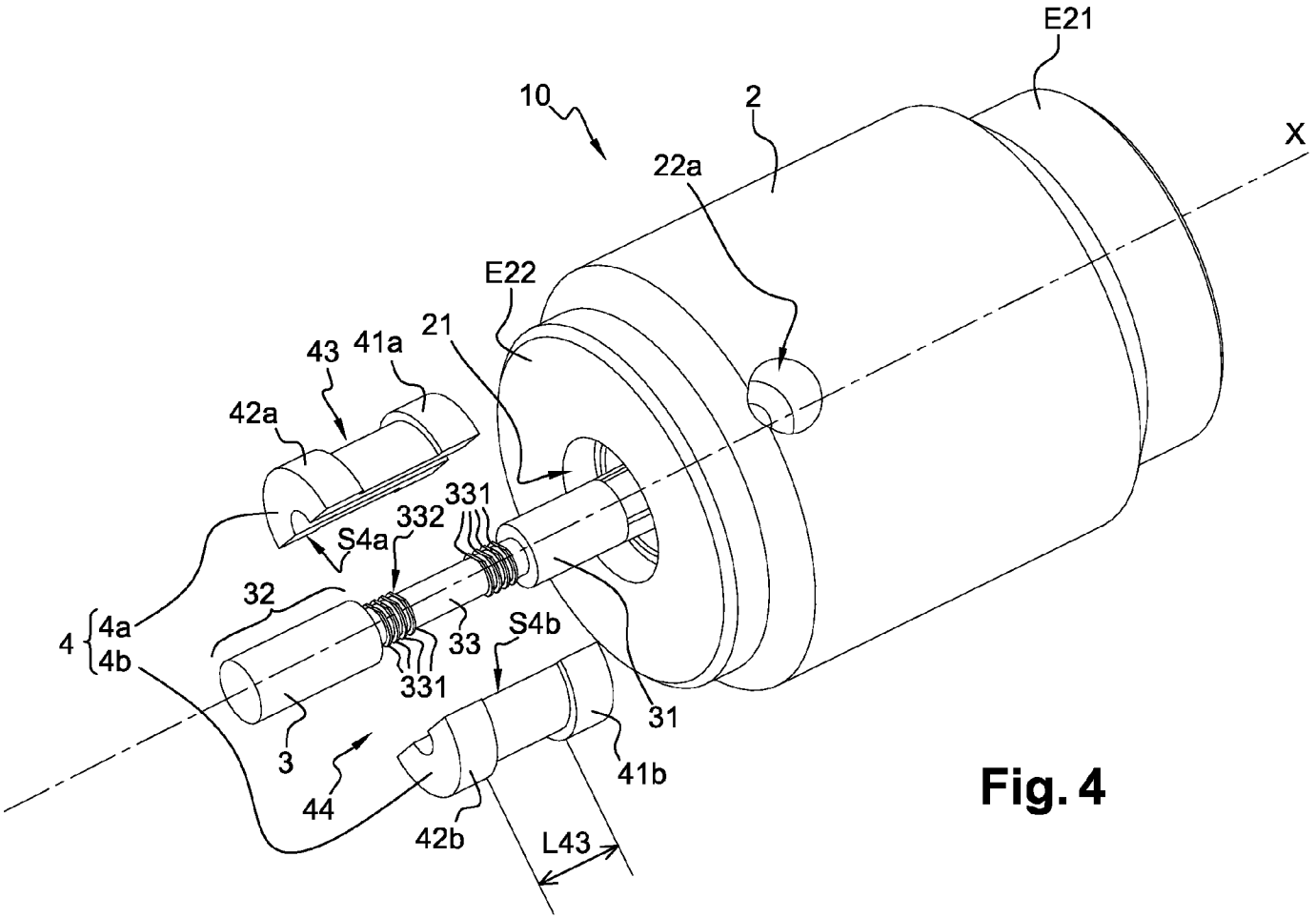
FIG. 4 is an exploded perspective view of the connection element of FIG. 3.
Figure 5:
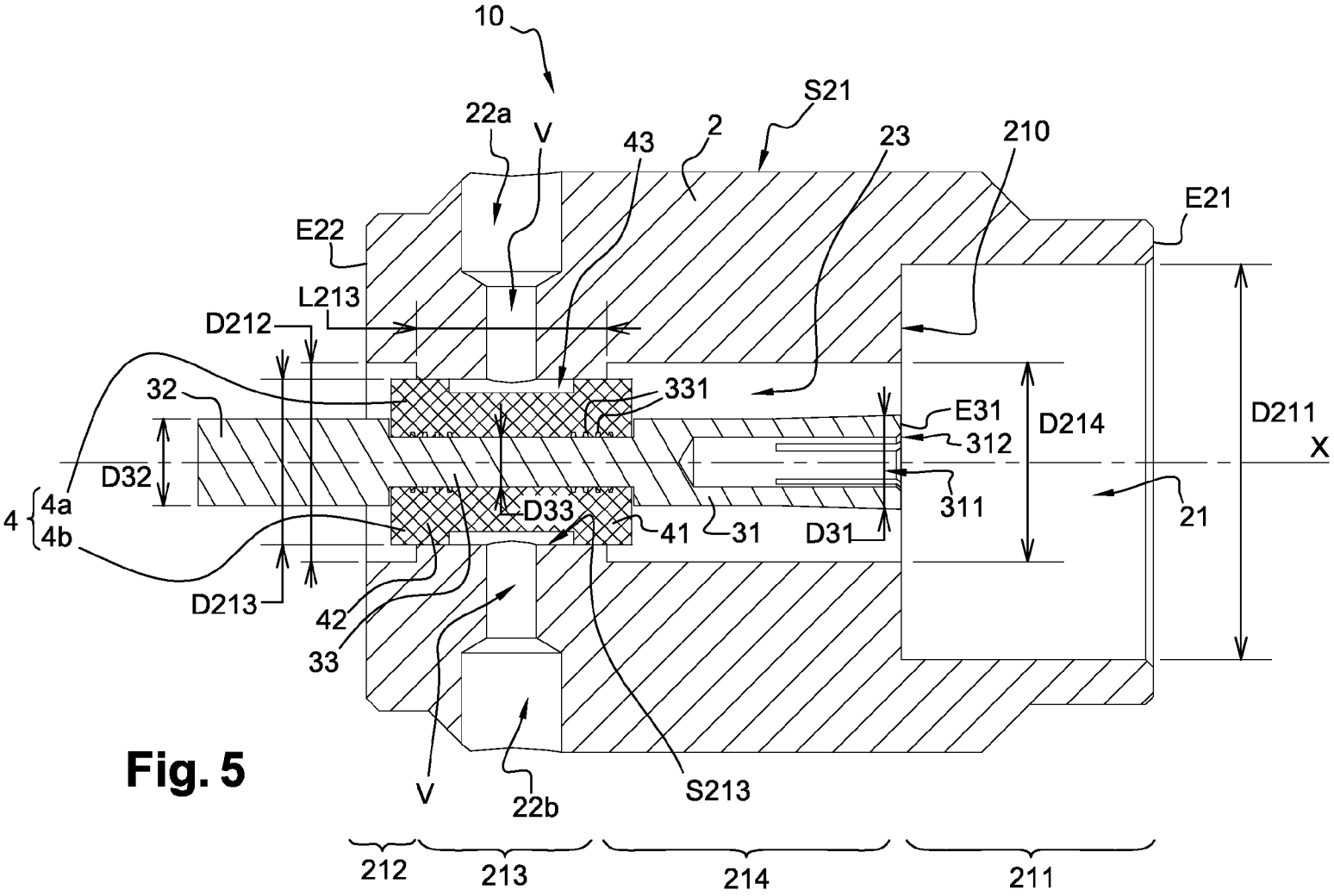
FIG. 5 is a cross-section along plane P5 in FIG. 3.

FIGS. 3, 4 and 5 show one of the connectors 10. Each connector 10 has a body 2, a contact rod 3, and a positioning ring 4. The elements 2, 3 and 4 generally each have a symmetry of revolution around a geometric axis X of the connector 10.

The body 2 is generally in the shape of a hollow cylinder with a circular section, centered on the axis X and passed through by a longitudinal passage 21 centered on the axis X. Along the axis X, the body 2 has a proximal end E22 and a distal end E21.

The adjective "proximal" refers to an element close to the proximal end E22, while the adjective "distal" refers to an element that is further therefrom. A surface here is described as "inner" if it is situated in the longitudinal passage 21 and turned toward the axis X, while a surface is described as "outer" if it is turned in the opposite direction, toward the outside of the connector 10. Furthermore, the surface is described here as "radial" or "axial" in the orientation of a normal to that surface.

The distal portion of the connector 10 is provided to fit with a complementary connector (not shown).

The longitudinal passage 21 includes four cylindrical portions 211 to 214 with a cylindrical section that are distributed along the axis X between the ends E21 and E22 and that communicate with one another. The proximal portion 212 and the distal portion 211 respectively emerge at the proximal E22 or distal E21 end of the body 2. The assembly portion 213 and the intermediate portion 214 are situated, along the axis X, between the portions 211 and 212. The portions 213 and 214 are adjacent and the assembly portion 213 emerges in the proximal portion 212, while the intermediate portion 214 emerges in the distal portion 211.

The portions 212 and 214 have a respective diameter D212 and D214 that is smaller than the diameter D211 of the distal portion 211. In these figures, the portions 212 and 214 have an identical diameter, but alternatively, the portions 212 and 214 have a different diameter. The diameter D213 of the assembly portion 213 is smaller than the diameters D212 and D214 of the portions 212 and 214.

For example, the diameter D211 is approximately 4.7 mm, the diameters D212 and D214 are approximately 2.4 mm, and the diameter D213 is approximately 2 mm.

The body 2 includes two coaxial holes 22*a* and 22*b* angularly spaced at 180°, connecting an outer surface S21 of the body 2 to the longitudinal passage 21. The holes 22*a* and 22*b* extend diametrically, in a radial direction, and emerge at the assembly portion 213 of the longitudinal passage 21.

The contact rod 3 is centered on the axis X and has three portions 31, 32 and 33 of circular section distributed along the axis X. The rod 3 is monolithic, i.e., formed in a single piece. A part of the proximal portion 32 protrudes, along the axis X, beyond the proximal end E22 of the body 2 and the outside of the longitudinal passage 21. The distal portion 31 of the contact rod 3 is housed in the intermediate portion 214 of the longitudinal passage 21.

The distal end of the distal portion 31 includes a blind hole 311 provided for fitting an electrical plug that is part of a complementary connector (not shown). The connector 10 is therefore a "female" connector designed to be electrically connected and mechanically assembled with the complementary connector, which is a "male" connector. Four slits 312 parallel to the axis X are formed in the distal portion 31 of the rod 3, around the blind hole 311, so as to form four elastic tabs commonly called a "tulip". During the connection of an electrical plug of a male connector in the blind hole 311, the tabs are mechanically pressed against the electrical plug, in a centrifugal direction, which favors mechanical and electrical contact between the rod 3 and the male electrical plug.

The portions 31 and 33 of the contact rod 3 have a respective outer diameter D31 or D32 that is smaller than the diameters D211, D212, D213 and D214 of the longitudinal passage 21, such that an annular space 23 extends radially between the connecting rod 3 and the body 2. In the figures, the portions 31 and 33 of the contact rod 3 have an identical diameter, but this is not compulsory. For example, the diameters D31 and D32 are approximately 1.05 mm.

The central portion 33 of the contact rod 3 has an outer diameter D33 that is smaller than the diameters E31 and E32 of the portions 31 and 32. For example, the diameter D33 is approximately 0.6 mm. Along the axis X, the central portion 33 is housed at the assembly portion 213 of the longitudinal passage 21. Thus, along the axis X, the central portion median area 33 of the contact rod 3 is situated at the holes 22*a* and 22*b*.

The ratios between the diameters D214/D31, D213/D33 and D212/D32 are determined such that the characteristic impedance, in the longitudinal passage 21 where the signal passes in wave form, is constant, or substantially constant, in each section of the connector 10, in light of the value of the dielectric constants of the ring 4 and the vacuum. Thus, the quality of the transmitted signal is optimal.

The central portion 33 of the contact rod 3 includes eight peripheral fins 331, four of which are formed near the proximal portion 31, and four others of which are formed near the distal portion 32. The fins 331 are raised elements that have a globally annular shape and that are centered on the axis X. The fins 331 are parallel to one another and are distributed along the axis X. As shown by FIG. 4, each fin 331 includes a flat portion 332 perpendicular to the axis X.

The ring 4 is globally in the form of a hollow cylinder with a circular section. The ring 4 has two parts and is made up of two half-rings 4*a* and 4*b* that are each globally in the shape of a hollow half-cylinder with a circular section extending along the axis X. The ring 4 can be made from a monolithic piece of revolution, which has a slit in a plane passing through the axis X so as to form the half-rings 4*a* and 4*b*. The half-rings 4*a* and 4*b* each include a flat inner surface S4*a* or S4*b*, parallel to the axis X. In the assembled configuration of the connector 10, the surfaces S4*a* and S4*b* are in contact with each other and form a slit 44 that separates the ring 4 into two portions.

The ring 4 is arranged around a central portion 33 of the rod 3. The length of the ring 4, measured along the axis X, is equal, with the exception of functional play, to the length of the slot formed by the reduced diameter of the central portion 33 of the rod 3. The ends of the ring 4 thus each abut against a shoulder formed by the reduced diameter between the portions 31 and 32 of the rod 3 and the central portion 33. This locks the translation of the ring 4 along the axis X, in both directions. However, a certain amount of axial play is present between the ring 4 and the rod 3.

The distal end of each half-ring 4*a* and 4*b* is extended radially outward by a peripheral half-flange 41*a* or 41*b*. Likewise, the proximal end of each half-ring 4*a* and 4*b* is extended radially outward by a peripheral half-flange 42*a* or 42*b*. The half-flanges 41*a* and 41*b* together form a distal flange 41, and the half-flanges 42*a* and 42*b* together form a proximal flange 42.

The ring 4 thus includes an outer annular peripheral slot 43 delimited on either side, along the axis X, by the flanges 41 and 42. The slot 43 communicates with the holes 22*a* and 22*b* of the body 2. Along the axis X, the length L43 of the slot 43 is smaller than the length L213 of the assembly portion 213 of the longitudinal passage 21. The flanges 41 and 42 bear against an inner surface S213 of the assembly portion 213, and respectively protrude in the proximal 212 and intermediate 214 portions of the longitudinal passage 21.

Resin R is present in a connected volume V extending in the holes 22*a* and 22*b* as well as in the slot 43 of the ring 4. The resin R is shown only in FIG. 2. The volume V is closed, except for the outer end of the holes 22*a* and 22*b*.

The rest of the description relates to a method for manufacturing the connector 10.

In a manufacturing step 1000, the ring 4 is manufactured, for example by molding or machining a block of material.

In a first manufacturing step 1001, to adjust the axial position of the contact rod 3 relative to the body 2, a removable shim C is inserted into the proximal portion 211 of the housing 21. The shim C is shown in FIG. 2 only for the connector located on the left and has a planar proximal surface C1 that is positioned against a shoulder 210 of the body 2, formed between the portions 211 and 214 of the longitudinal passage 21, such that the surface C1 delimits the distal end of the intermediate portion 214 of the longitudinal passage 21.

In a second step 1002, the two half-rings 4*a* and 4*b* are arranged on either side of the central portion 33 of the contact rod 3. This operation is carried out while the rod 3 is separated from the body 2, when it is not placed in the longitudinal passage 21. The ring 4 is made from PTFE (Teflon), such that it is slightly deformable and elastic. When the two half-rings 4*a* and 4*b* are arranged on either side of the central portion 33, the peripheral fins 331 deform the ring 4 and push it superficially into the ring 4, which locks the translation of the ring 4 along the axis X relative to the rod 3. In this way, the axial position of the ring 4 relative to the rod 3 is precisely fixed. The rotation of the ring 4 relative to the rod 3 is locked owing to the flat portions 332 of the peripheral fins 331.

In a third step 1003, the assembly formed by the contact rod 3 and the ring 4 is inserted into the longitudinal passage 21. The distal end E31 of the rod 3 is brought into contact with the distal surface C1 of the shim, which precisely positions the rod 3 relative to the body 2. The slot 43 of the ring 23 is then in communication with the holes 22*a* and 22*b* of the body 2.

In a fourth step 1004 occurring after the third step 1003, a liquid resin R is injected into one of the two holes 22*a* or 22*b*, the other hole 22*b* or 22*a* serving to discharge air and the excess resin. When the resin R appears at the other hole 22*b* or 22*a*, this means that a correct quantity of resin has been injected. For example, the resin used is a bi-component epoxy resin. The resin R thus fills the volume V, i.e., both the holes 22*a* and 22*b* and the slot 43 of the ring 4. While hardening, the resin R fastens the ring 4 to the body 2. The contact rod 3 being kept in position relative to the contact rod 3, the contact rod 3 is also stationary relative to the body 2.

The manufacturing step 1000 for manufacturing the ring 4 takes place before the steps 1002, 1003 and 1004.

A connector 10 having the dimensions cited above as an example allows satisfactory transmission of a hyperfrequency signal in the vicinity of 50 GHz. Such a connector complies with the existing standards in terms of dimensions, mechanical strength relative to assembly and endurance forces, such as standard IEC 61 169/40 for a 2.4 mm type connector, for example. The manufacture of such a connector can be industrialized at a low cost.

The ring 4 being made from PTFE, it has good radiofrequency performance. Furthermore, the ring 4 can be placed without requiring the implementation of a molding operation, which simplifies the manufacture and avoids introducing manufacturing defects resulting from the molding.

Owing to the invention, it is possible to adjust the position of the contact rod 3 precisely relative to the body 2, before the resin R hardens. The connector 10 is thus easier to manufacture, and the connector 10 has a precisely controlled geometry, which guarantees good reliability and increases its lifetime.

The volume of resin is limited in the connector 10. In this way, the radiofrequency performance of the connector 10 is correct.

The resin does not deform the ring 4, which does not cause mismatching in the hyperfrequency domain.

The connector 10 is adapted to correctly transmit signals having a frequency of approximately 50 GHz, as it has a simple design and can be made easily with small dimensions. It may, however, be used to operate at lower frequencies, in a satisfactory manner, in particular by increasing its dimensions.

Alternatively, the ring 4 is made from an insulating material different from PTFE, in particular to improve the mechanical strength of the connector 10.

The connector 10 can be adapted to standardized interfaces, for example of the SMA, 2.9 mm, K or V type.

The connector 10 is a female connector, but alternatively, it may be a male connector. In that case, the blind hole 311 of the contact rod 3 is replaced by a solid plug provided to be inserted into a hole of a female contact rod that is part of a complementary female connector.

The characteristic impedance of the connector 10 is globally constant in all of the transverse sections of the connector 10, along the axis X. The characteristic impedance is precisely controlled, in light of the differences between the dielectric constants of the ring 4 and the resin R, and by the definition of the dimensions of the connector 10. In particular, the diameters D211, D212, D213 and D214 of the different portions 211 to 214 of the longitudinal passage 21 and the diameters D31, D32 and D33 of the rod 3 are defined in light of that difference in dielectric constants. For example, at the ring 4, the diameter D213 of the longitudinal passage is smaller than the diameter D212 and D214 of the portions 212 and 214 to account for the reduced diameter of the central portion 33 of the rod 3.

The contact rod 3 is monolithic, which simplifies the manufacture of the connector 10 and decreases the risks of manufacturing defects. This also improves the precision of the dimensions of the connector, which improves the reliability of its operation and its lifetime.

The ring 4 is solid, i.e., it does not include recesses aside from its central hole. This makes it possible to transmit signals without altering the quality thereof.

The ring 4 is removable before the step 1004, i.e., before the resin R is housed in the holes 22*a* and 22*b* and the slot 43 of the ring 4. Before the step 1004, the resin R can be housed in the holes 22*a* and 22*b* and in the slot 43 of the ring 4. Before the step 1004, the resin R is housed in the holes 22*a* and 22*b* and the slot 43 of the ring 4, and fastens the ring 4 to the body 2. The ring 4 is therefore no longer removable after the step 1004.

Alternatively, the slit 44 of the ring 4 is not parallel to the axis X of the ring 4, but extends in a direction that has a circumferential component, inasmuch as that direction also has an axial component.

Alternatively, the ring 4 is monolithic and the slit extends only over a portion of the ring. In that case, to manufacture the connector 10, during the step 1002, the two portions of the ring 4 that are separated by the slit are separated from one another so as to allow the ring to be inserted around the contact rod 3. The ring then returns to its initial geometry through elastic return of the two portions against the rod 3. The two portions of the ring are connected to each other by the material of the ring and are not separable.

Alternatively, the fins 331 are replaced by raised elements having a different geometry, for example spurs or harpoons.

In the context of the invention, the various alternatives may be combined with each other.

The invention claimed is:

1. A hyperfrequency connection element, designed to be electrically connected with a complementary connector, comprising:

a body comprising an inner passage surrounding a central axis, a monolithic conductive contact rod extending along the central axis, and an insulating ring surrounding the central axis, wherein the body includes at least one hole that connects an outer surface of the connector to the inner passage, wherein the ring is solid and deformable, wherein the ring comprises an outer peripheral slot communicating with the hole, wherein a resin securing the ring with the body is housed in the hole and in the slot of the ring, and wherein the ring is removable before the resin is housed in the hole and in the slot of the ring.

2. The element according to claim 1, wherein the ring further comprises a slit extending in a direction having at least one axial component and passing all the way through the ring, and wherein the ring is formed by two separable half-rings.

3. The element according to claim 1, wherein the ring is monolithic and elastically deformable, and wherein the ring further comprises a slit extending in a direction having at least one axial component, the slit passing only through a portion of the ring, the ring comprising two portions separated by the slit and connected to each other.

4. The element according to claim 1, wherein a first portion of the contact rod around which the ring is mounted comprises at least one raised element, and wherein the translation and rotation of the ring relative to the contact rod, in relation to the central axis, are locked by the raised element.

5. The element according to claim 4, wherein the raised elements include at least one annular outer flange having a flat portion locking the rotation of the ring relative to the contact rod.

6. The element according to claim 1, wherein the ring is made from polytetrafluoroethylene.

7. A hyperfrequency connection assembly, wherein it comprises a platen and at least one hyperfrequency element according to claim 1, fastened to the platen.

8. A method for manufacturing a hyperfrequency connection element according to claim 1, wherein it comprises at least the steps of:

placing the insulating ring around the conducting rod, inserting the assembly formed by the ring and the conducting rod into the longitudinal passage of the body, and injecting an adhesive material into the hole to fill the slot of the ring.

9. The method according to claim 8, wherein during the placing step, two half-rings are arranged on either side of the conducting rod.

10. The method according to claim 8, wherein during the placing step, two portions of the ring are separated to insert the ring around the conducting rod.

* * * * *